United States Patent [19]

George et al.

[11] 4,029,013

[45] June 14, 1977

[54] WRAP AROUND GRAVURE PRINTING APPARATUS

[75] Inventors: Harvey F. George, West Hempstead; Jitendra N. Shah, Hicksville; Robert H. Oppenheimer, Glen Cove, all of N.Y.

[73] Assignee: Gravure Research Institute, Inc., Port Washington, N.Y.

[22] Filed: May 11, 1976

[21] Appl. No.: 685,359

Related U.S. Application Data

[63] Continuation of Ser. No. 565,783, April 7, 1975, abandoned, which is a continuation of Ser. No. 398,707, Sept. 19, 1973, abandoned.

[52] U.S. Cl. ..... 101/382 MV; 29/125

[51] Int. Cl.[2] ..... B41F 27/00

[58] Field of Search ..... 101/382 MV, 382 R, 375, 101/378, 247; 29/125, 130

[56] References Cited

UNITED STATES PATENTS

| | | | |
|---|---|---|---|
| 1,123,055 | 12/1914 | Wood | 101/378 |
| 1,140,860 | 5/1915 | Wood | 101/177 X |
| 1,344,648 | 6/1920 | Nordfors | 101/382 R |
| 1,442,178 | 1/1923 | Raabe | 101/378 X |
| 2,189,682 | 2/1940 | Schumtz | 101/378 X |
| 2,788,743 | 4/1957 | Schwerin | 101/382 MV |
| 3,001,472 | 9/1961 | Parrish | 101/378 |
| 3,358,598 | 12/1967 | Middleton | 101/378 |
| 3,490,369 | 1/1970 | Huck | 101/378 |
| 3,735,697 | 5/1973 | Provan | 101/247 X |
| 3,882,775 | 5/1975 | Lytle et al. | 101/382 MV |

FOREIGN PATENTS OR APPLICATIONS

| | | | |
|---|---|---|---|
| 1,451,620 | 9/1965 | France | 101/382 R |

*Primary Examiner*—E. H. Eickholt
*Attorney, Agent, or Firm*—Bryan & Bollo

[57] ABSTRACT

A rotogravure printing plate for use in rotogravure printing, the plate having a non-resilient backing of a magnetically attractable material for mounting and holding the plate in fixed position on a magnetic cylinder, the plate having a surface into which wells for receiving ink may be formed so that, during printing with the plate mounted and held in position on the magnetic cylinder, ink deposited in the wells will be transferred to an ink receiving surface onto which the image formed by the wells on the plate is to be rotogravure printed.

6 Claims, 7 Drawing Figures

WRAP AROUND GRAVURE PRINTING APPARATUS

This application is a Continuation of application Ser. No. 565,783, filed Apr. 7, 1975 now abandoned which is a Continuation of application Ser. No. 398,707, filed Sept. 19, 1973 now abandoned.

This invention relates to apparatus for rotogravure printing and, more particularly, to apparatus for rotogravure printing of multi-page impressions in which page or double page size engravings are etched or engraved onto separate page or double page gravure plates.

In rotogravure printing, as presently practiced, engravings for a plurality of pages, for example, 16, 20, 24, or 28 pages, to be printed are laid out and etched or engraved into the surface of a cylinder and the cylinder is then used for direct or offset printing of multi-page impressions. After printing, the multi-page printing impressions are slit, cut, folded and assembled, in a pre-determined manner, to create signatures. Signatures may be bound together along one edge, such as in a book, or may be stapled or left loose. The engraving for the individual pages are laid out, etched or engraved into the surface of the cylinder so that, when the impressions are folded and assembled, the individual pages are in proper sequence. Thus, the printed image of each of the plurality of page size engravings becomes one page of the printed and assembled product.

The preparations for and the etching or engraving of rotogravure cylinders for the printing of the plurality of pages representing a printing impression is expensive, time consuming and substantially inflexible. The page sequence of the final product must be established before the etching or engraving of the rotogravure printing cylinder has been etched or engraved, changes on a single page often require the removal of all of the etching or engraving of all of the pages on the cylinder, replating and re-etching or reengraving of the whole cylinder. Changes that might be desirable often times, because of time and expense, are not made. Because of the expenses in preparing the cylinders and difficulties in making changes, rotogravure printing has been limited, for the most part, to longer run printing where substantial numbers of copies will be printed without changes. This has been true despite the high printing quality attainable with rotogravure printing as compared to other processes.

Many of the problems which add to the expense of rotogravure printing and make rotogravure substantially inflexible are the result of the etching or engraving of the images of a plurality of pages onto the surface of the rotogravure cylinder. In other types of multi-page printing, such as in letter press, similar difficulties have been overcome by the utilization of page size plates. The image of the copy to be printed is first formed on the plates and a plurality of such plates are then affixed or attached to drums or cylinders for printing. However, in letter press as well as in lithography, the process employed for inking the image and for the transfer of the inked image from the printing drum or cylinder onto the print receiving web are quite different from the inking and transfer processes in rotogravure printing.

The image in letterpress printing is raised on the surface of the plate. The raised surface of the image is inked and the ink from this raised surface is transferred to the material receiving the printing. Because, in letterpress printing, the image is raised, interruptions to the surface of the cylinder or drum, such as by plate edges or attaching means for the plates, have no adverse effect upon the printing so long as there are no projections or raised surfaces on the cylinder or drum projection to or beyond the raised image surfaces.

The image in lithographic printing is formed on the surface of the plate, cylinder or drum. This is accomplished by sensitizing the surface so that, in the image portion, the surface is wetted by and retains the ink for printing. Lithographic ink is thick and viscous and is retained on the sensitized areas. During printing the ink is transferred from such areas to the print receiving substrate. Because the ink is thick and viscous and the unsensitized surface is ink repellant, there is no problem of ink transfer from other areas. If any of the lithographic ink should become deposited in areas lying below the surface of the plate, such ink, because of its thickness and viscosity is not transferred during printing. Thus, in lithographic printing, interruptions to the surface of the cylinder or drum, such as by plate edges or attaching means, have no adverse effect upon the printing.

The image in rotogravure printing, as has already been noted, is etched or engraved into the surface of the cylinder. The etching or engraving forms small recesses or wells in the surface which, in the rotogravure process, are filled with ink for printing. The cylinder is passed through a reservoir of a highly fluid ink, or is flooded with such an ink. The ink is wiped from the surface of the cylinder by a doctor blade but remains in the recesses or wells. The ink from the recesses or wells is transferred to the material receiving the printing when such material is brought into contact with the surface of the cylinder. Unlike letterpress, where the image is raised and the ink is on the raised surface, and lithography, where the retained ink is on and above the surface of the plate, in gravure printing the ink is at and below the surface of the cylinder.

The application of the fluid printing ink into the recesses or wells in the surface of the rotogravure cylinder and the passing of the cylinder through a reservoir and past a doctor blade, has, heretofore, precluded the use of removable page size plates on the cylinder for rotogravure printing. One of the problems precluding the use of such plates has been the difficulty of attaching a plurality of such plates to a cylinder in such a way that the plates can be held in fixed position on the cylinder during printing and, at the same time, individual plates can be removed and replaced. Another problem has been the unwanted printing of images resulting from ink deposited and accumulating at plate edges and gaps between plates and the ink spatter and wear resulting from the passage of plate edges past the doctor blade.

These and other problems which, heretofore have precluded the use of copy plate units for rotogravure printing are overcome in the apparatus of the instant invention.

In the instant invention, the copy to be printed is etched or engraved into the surface of a plate having a backing of a magnetically attractable material. The plates are of a size so that, when a plurality of such plates are wrapped around and mounted on the cylinder, the plates cover the entire surface of the cylinder which, during rotogravure printing, will contact the material receiving the ink image. The edges of the plates which, when the plates are wrapped around and mounted on the drum, will abut and extend axially across the drum, are cut at an angle, such as at 5°.

In the practice of the instant invention, the plates are mounted on a magnetic cylinder and are held on the cylinder by the magnetic attraction between the magnetically attractable backing on the plates and the cylinder. The plates may be etched or engraved with the image to be printed while the plates are flat and the plates might then be curved to conform substantially to the curvature of the magnetic cylinder or the plates may first be curved and then etched or engraved with the image.

When wrapped around and magnetically attracted to the magnetic cylinder, the plates and cylinder become a solid, firm and rigid unit substantially the same as where the image to be printed is etched or engraved directly into the cylinder surface. This is of substantial importance because it assures quality printing, in proper registry, when the material to receive the ink image is brought into intimate contact with the plates on the cylinder. At the same time, one or more of the plates can be removed and replaced should a change or changes in one or more of the copy pages be required. This is of substantial importance because it allows for such change or changes without etching or engraving the entire cylinder. The time and expense involved in making a change are substantially reduced. Long run printing, where one or more of the pages require change during printing, is practical.

The present invention will be more fully understood from the following description and appended drawings of preferred embodiments of the invention in which FIG. 1 is a perspective view of a plate for use in the instant invention;

Figure 1:
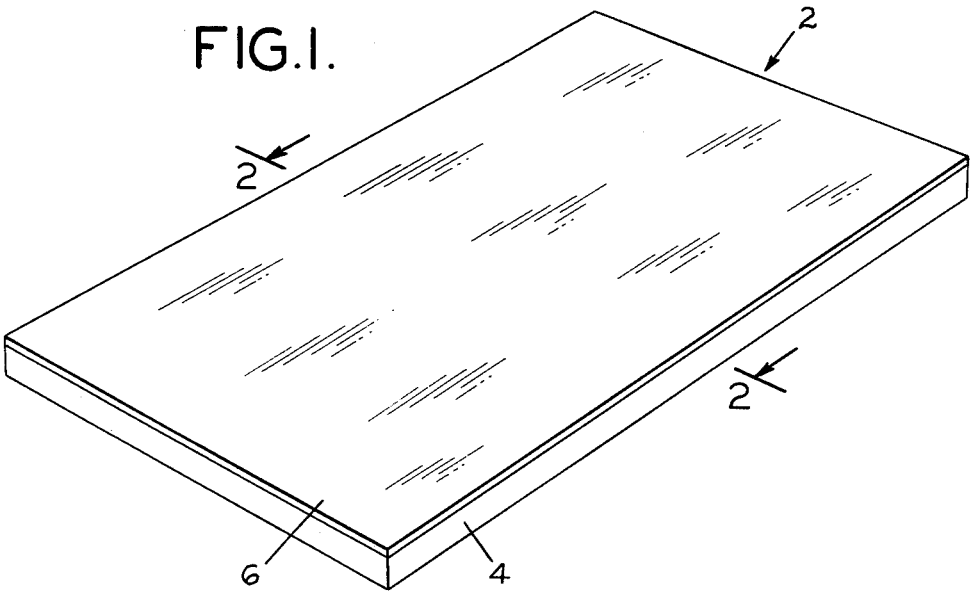

Referring to the drawings and, particularly FIG. 1, the plate, generally designated 2, has a backing, 4, of magnetically attractable material, such as steel, and a surface, 6, of material suitable for etching or engraving. Copper, the material most commonly used as the surface material on cylinders for rotogravure printing, has been found to be a particularly suitable material for the etching or engraving surface.

Plate 2 should be of sufficient thickness so that, in handling, etching or engraving, the plate will not wrinkle or distort. At the same time, the thickness of the plate should not be so great as to prevent or make the shaping of the plate substantially to the curvature of the magnetic cylinder difficult. A plate having an overall thickness not substantially less than 0.008 inches and not substantially greater than 0.012 inches with a copper surface at the surface to be etched or engraved of a thickness not substantially less than 0.002 inches and not substantially greater than 0.003 inches has been found to be satisfactory.

Figure 2:
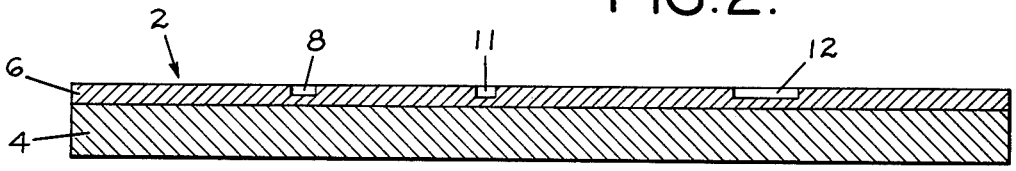
FIG. 2 is a cross section view of the plate of FIG. 1, taken at 2—2, FIG. 1, and showing representative etched or engraved ink receiving wells in the plate surface for rotogravure printing.

Copper surface 6 of plate 2, as best shown in FIG. 2 is etched or engraved to form therein ink reservoirs or wells 8, 11, 12, the size and depth of such wells being shown in enlarged size in FIG. 2. In the practice of the instant invention, the wells may be etched or engraved in customary manner and may be of the customary size. The dimensions of such wells are usually measured in microns and vary in opening size and depth depending upon the lightness or darkness of the tone to be printed at the particular point. Copper surface 6 of plate 2 may be etched or engraved with plate 2 flat and the plate may then be shaped to the curvature of the magnetic cylinder or plate 2 may first be shaped and copper surface 6 then etched or engraved. After etching, the surface of plate 2 may be chromium plated, in conventional manner, as is the practice where a wear resistant surface for long plate life is desired.

Figure 3:
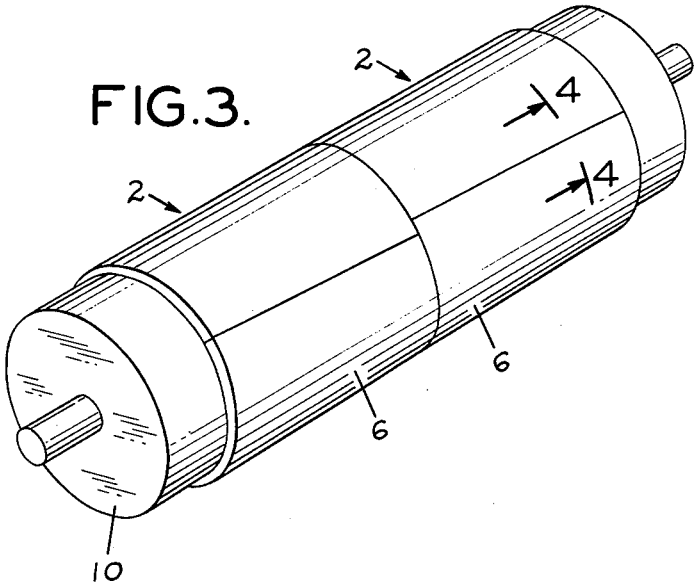
FIG. 3 is a perspective view of a cylinder for rotogravure printing with plates of the configuration of FIGS. 1 and 2 affixed thereto.
Figure 4:
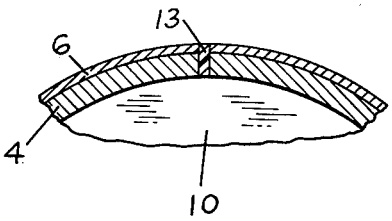
FIG. 4 is an enlarged view, taken at 4—4, FIG. 3, showing an embodiment of the invention with the spacing or the gap between the plates in FIG. 3 filled with a filler.

As best shown in FIG. 3, plates 2, shaped to the curvature of the cylinder are wrapped around and held in firm contact with the magnetized surface of cylinder 10 by engaging backing 4 of plates 2 with the magnetized surface of cylinder 10. The sizes of plates 2 may be varied, depending upon the size of the copy to be printed. As best shown in FIG. 3, plates 2 are matched with the surface of cylinder 10 so that, when placed on the cylinder, the surface of cylinder 10 which, otherwise, would be contacted by the material receiving the ink image, is covered by plates 2. Preferably, plates 2 are of single page or single copy size so that the abutting edges of the plates, during the rotogravure printing process, will contact the material receiving the ink images between the printed single pages or printed single copies. Depending upon the page or copy lay out of the material to be printed, plates 2 may be curved and magnetically affixed to magnetic cylinder 10 so as to print the pages or copy top-to-bottom, bottom-to-top, or side-to-side. In any event, as best shown in FIG. 3, the leading and trailing edges of the plates, abutting axially across the cylinder, are shaped or cut at an angle, for example an angle of 5°, relative to the axis of rotation of cylinder 10. As will be more fully described, for some rotogravure printing operations, the abutting edge of plates 2, as is best shown in FIG. 4, may be filled with filler 12. A quick drying material, such as an epoxy, which is compatable to the materials of plates 2 and cylinder 10, in insoluble in the printing ink, is wear resistant and non-porous and which can be applied as a thick fluid or paste and will dry or harden level and smooth, is preferred for use as the filler material.

Figure 5:
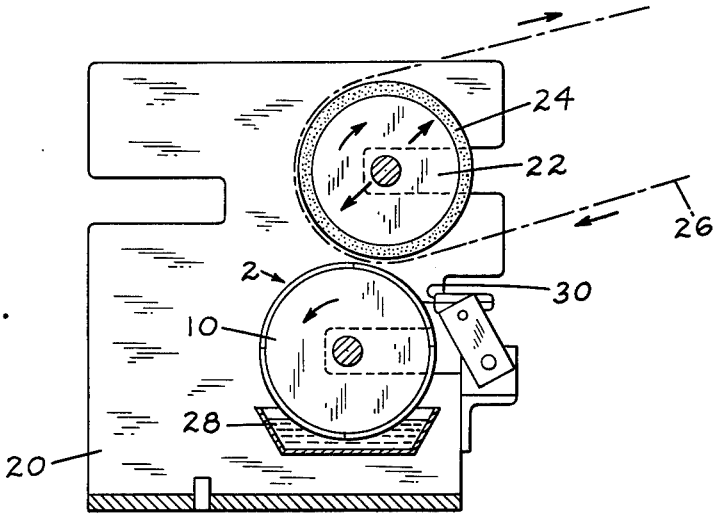
FIG. 5 is a diagrammatic view showing the emobodiment of the instant invention as applied to direct rotogravure printing.
Figure 6:
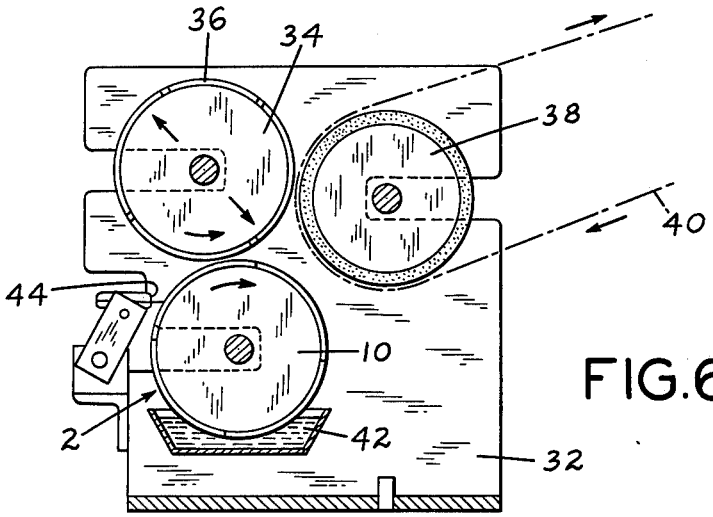
FIG. 6 is a diagrammatic view showing the embodiment of the instant invention as applied to offset rotogravure printing.

As best shown in FIGS. 5 and 6, magnetic cylinder 10, with a plurality of plates 2 magnetically affixed thereto, may be utilized for direct rotogravure printing, FIG. 5, or offset rotogravure printing, FIG. 6. Referring first to FIG. 5, magnetic cylinder 10, with plates 2 magnetically affixed thereto, is mounted on frame 20 of a rotogravure press and is rotated in the direction of the arrows by a conventional press drive, not shown. Impression cylinder 22, having a conventional resilient surface 24, such as of rubber, is mounted on frame 20 and is rotated in the direction of the arrow. Web 26, of a material such as paper, is fed between plates 2 on cylinder 10 and impression cylinder 22 in the direction of the arrows. As web 26 passes between plates 2 and impression cylinder 22, ink from the wells in the surface of plates 2, as such wells come into registry with web 26, are transferred to the web forming on web 26 the desired printed image. Resilient surface 24 of impression cylinder 22 may be undercut in the areas which overlie the plate gaps during printing so as to minimize pressure in such areas during printing.

In the embodiment of FIG. 5, as magnetic cylinder 10 rotates in the direction of the arrow, cylinder 10 passes through ink reservoir 28. The ink on the surface of plates 2 on cylinder 10 is wiped off of the surface by doctor blade 30, leaving in the recesses or wells, such as 8, 11, 12, FIG. 2, the ink to be transferred to and printed on web 26 as the recesses or wells in plates 2 contact web 26 at the impression cylinder 22.

In wiping the ink off of the surface of plates 2, and leaving the ink deposited in recesses or wells, such as 8, 10, 12, doctor blade 30, in the embodiment of FIG. 5, will also wipe ink into and leave ink deposited in the gaps between plates 2, unless such gaps are filled with a filler, such as filler 1, FIG. 4. When deposited and retained in the unfilled gap, such ink filled gap will cause an ink image to be transferred from plates 2 on cylinder 10 to web 26 when the web contacts the plate gap. Because of the size of the plates and the locations of the gaps between the single pages or copies, the ink image printed by the gap may be trimmed from the pages if such pages are to be trimmed. Preferably, as already noted, the plate gaps can be filled with filler 13, FIG. 4, to eliminate the gap and resulting printed gap image. In the latter instance, the need for trimming is eliminated.

In the offset rotogravure printing embodiment of FIG. 6, magnetic cylinder 10, with a plurality of plates 2 magnetically affixed thereto is mounted on frame 32 of the press and is rotated in the direction of the arrow by a conventional press drive, not shown. Transfer cylinder 34, covered by offset blanket 36, and impression cylinder 38 are mounted on frame 32 and rotate in the direction of the arrows by the conventional press drive, not shown. Web 40, of a material such as paper, is fed between blanket 36 of transfer cylinder 34 and impression cylinder 38.

In the offest printing embodiment of FIG. 6, magnetic cylinder 10 with plates 2 affixed thereto, is rotated through ink reservoir 42 and, as the cylinder and plates rotate past doctor blade 44, the ink is wiped off of the surface of plates 2. As cylinder 10 rotates, the ink in the recesses or wells, such as 8, 11, 12, in plates 2 is transferred to blanket 36 on transfer cylinder 34 and, from blanket 36, is transferred to web 40 as the web on impression cylinder 38, contacts blanket 36 carrying the ink images.

Figure 7:
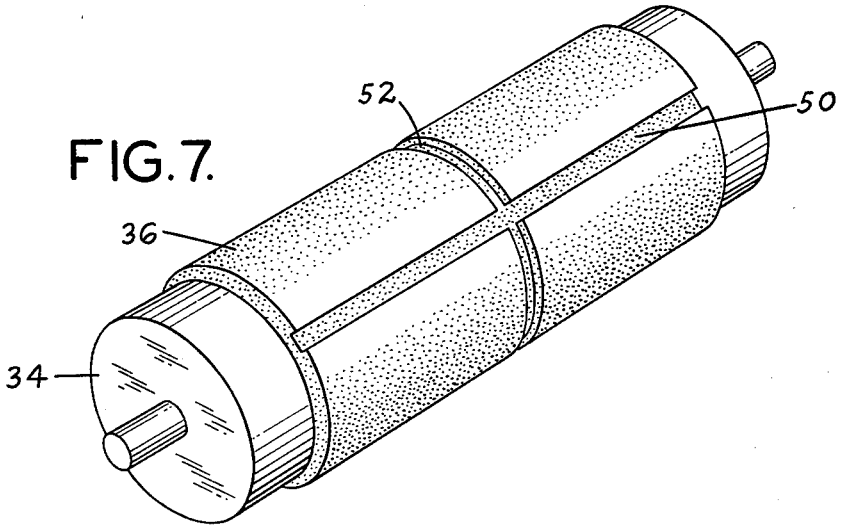
FIG. 7 is a view of the under cut blanket roll used on the transfer roll in the embodiment of FIG. 6 in the practice of the instant invention.

As best shown in FIG. 7, in the offset printing embodiment of the invention in FIG. 6, it is preferred to undercut blanket 36 on transfer cylinder 34 in those areas on the blanket which, as blanket 36 contacts plates 2 on magnetic cylinder 10, coincide with the gaps between plates 2. In this way, filling the gaps with a filler, such as filler 13, FIG. 4, to eliminate the printing of a gap image is not required. Thus, as best shown in FIG. 7, blanket 36 is undercut, at 50, transversely of the blanket on transfer cylinder 34 and, at 52, circumferentially. Undercut 50 may be slightly angled to match the angle of the leading and following plate edges or may be of sufficient width to accommodate the angled plate edges during printing. Undercut areas 50, 52 are aligned with plates 2 on magnetic cylinder 10 so that, as plates 2 on cylinder 10 contact blanket 36 on impression cylinder 34, the gaps between plates 2 do not contact blanket 36 but, rather, are straddled by the areas undercut in blanket 36. Hence, any ink that might be deposited, wiped into or retained in the gaps between plates 2 is not transferred to blanket 36. This eliminates any transfer of ink gap images from plates 2 on magnetic cylinder 10 to blanket 36 on transfer cylinder 34 and printing of such gap images on web 40.

Plates 2, in the instant invention, are held in fixed position on magnetic cylinder 10 by the magnetic attraction between the cylinder and backing 6. Each plate is held on the cylinder independent of the other plates so held. Thus, without disturbing any of the other plates on the cylinder, individual plates can be removed and replaced. When the gaps between abutting plates have been filled with a filler, such as 13, the filler between the plate removed and the abutting plates is also removed and replaced after the replacement plate is positioned on the magnetically attracted to cylinder 10. The removal and replacement of individual plates without removing or disturbing other plates allows partial change of the copy material to be printed. Such partial change of the copy material to be printed is of substantial importance in the printing of newspapers, magazines, and the like, where partial changes in copy material from edition to edition or for circulation in different regions is desirable.

In the direction in which plates 2 of the instant invention will be used in rotogravure printing, the leading and trailing edges are cut or formed at an angle, such as an angle of about 5°. Preferably, so that the plates might be wrapped around and fitted to cylinder 10 with minimum of spacing or gap between the plates, the angular leading and trailing edges are parallel and all plates are cut or formed at the same angle. The side edges of the plates are cut or formed so that the sides are parallel and, when on magnetic cylinder 10 are in the direction of rotation of cylinder 10. The angular arrangement of the leading and trailing edges of plates 2 on cylinder 10 prevents shocks on the doctor blade when the gap passes under the doctor blade edge as cylinder 10 rotates. Rather than angling the edges of the plates, the doctor blade might be mounted at an angle relative to cylinder 10. This is of particular importance where the abutting edges are not filled with a filler, such as 13, because it prevents ink splattering and wear on the doctor blade. Where the gaps are filled, and especially in longer rotogravure printing runs, uneven wear of the doctor blade on the printing surface formed by the plate surfaces and the filler is prevented.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A rotogravure printing cylinder for use in rotogravure printing, including:

a cylindrical core;

a plurality of printing plates shaped to conform with the contour of the surface of said cylindrical core, each of said printing plates including the entire image to be printed on a single printed page and having a backing, a layer of material suitable for etching engraving affixed to said backing, said layer having printing recesses formed therein for receiving printing ink;

said printing plates being magnetically held in a fixed position on said cylindrical core with said backings in contact with the surface of said cylindrical core, said printing plates being readily individually removable or replaceable as desired to change the image to be printed on a particular page of printing or the order of the printed pages;

said printing plates being mounted on said cylindrical core with adjacent printing plates in direct abutting contact with one another forming single joints therebetween, and with the edges of each printing plate which extend in the direction of the longitudinal axis of said cylindrical core being parallel to each other and disposed at an angle of approximately 5° relative to the longitudinal axis of said cylindrical core to minimize paper waste during printing.

2. A rotogravure printing press for use in direct rotogravure printing, including:

a cylindrical core;

a plurality of printing plates shaped to conform with the contour of the surface of said cylindrical core, each of said printing plates having a backing material and a printing surface with recesses formed therein for receiving printing ink;

said printing plates being magnetically held in a fixed position on said cylindrical core with said backings in contact with the surface of said cylindrical core, and being positioned on said cylindrical core with adjacent printing plates in direct abutting contact with one another forming single longitudinal or circumferential joints therebetween; and an impression cylinder having a resilient surface with longitudinal and circumferential undercuts coextensive with the joints between said printing plates, each of said longitudinal undercuts extending along the entire length of said resilient surface and having sufficient width to overlie the longitudinal joints of said printing plates, each of said longitudinal undercuts extending around the entire circumference of said resilient surface and having sufficient width to overlie the circumferential joints of said printing plates so that during printing as a web passes through the nip between said impression cylinder and the juxtaposed printing plates, said longitudinal and circumferential undercuts will mate with the joints to minimize pressure at the joints during printing, thereby minimizing any ink transfer at the joints.

3. The rotogravure printing press recited in claim 2 wherein:

the edges of each printing plate which extend in the direction of the longitudinal axis of said cylindrical core are parallel to each other and disposed at an angle of approximately 5° relative to the longitudinal axis of said cylindrical core.

4. A rotogravure printing press for use in offset rotogravure printing, including:

a cylindrical core;

a plurality of printing plates shaped to conform with the contour of the surface of said cylindrical core, each of said printing plates having a backing material and a printing surface with recesses formed therein for receiving printing ink;

said printing plates being magnetically held in a fixed position on said cylindrical core with said backings in contact with the surface of said cylindrical core, and being positioned on said cylindrical core with adjacent printing plates in direct abutting contact with one another forming single longitudinal or circumferential joints therebetween;

a transfer cylinder having a blanket with longitudinal and circumferential undercuts coextensive with the joints between said printing plates, each of said longitudinal undercuts extending along the entire length of said blanket and having sufficient width to overlie the longitudinal joints of said printing plates, each of said circumferential undercuts extending around the entire circumference of said blanket and having sufficient width to overlie the circumferential joints of said printing plates so that during printing at the nip between said transfer cylinder and the juxtaposed printing plates said longitudinal and circumferential undercuts will mate with the joints to prevent ink transfer from the joints to said blanket; and an impression cylinder adapted to receive a web for printing contact with said blanket for transferring printing ink from said blanket to the web.

5. The rotogravure printing press recited in claim 4, wherein:

the edges of each printing plate which extend in the direction of the longitudinal axis of said cylindrical core are parallel to each other and disposed at an angle of approximately 5° relative to the longitudinal axis of said cylindrical core.

6. A rotogravure printing cylinder for use in rotogravure printing including:

a cylindrical core;

a plurality of printing plates shaped to conform with the contour of the surface of said cylindrical core, each of said printing plates including a backing, a copper layer affixed to said backing, said copper layer having copy printing recesses formed therein for receiving printing ink, and a chromium layer affixed to said copper layer to provide a wear resistant surface;

said printing plates being magnetically held in a fixed position on said cylindrical core with said backings in contact with the surface of said cylindrical core;

said printing plates being mounted on said cylindrical core with adjacent printing plates in direct abutting contact with one another forming single joints therebetween, the edges of each printing plate which extend longitudinally in the direction of the longitudinal axis of said cylindrical core being parallel to each other and disposed at an angle of approximately 5° relative to the longitudinal axis of said cylindrical core, whereby individual printing plates may be readily removed and replaced as desired to change the image to be printed and wasted printing space between said printing plates is minimized.

* * * * *